US009422789B2

(12) United States Patent
Bushman et al.

(10) Patent No.: US 9,422,789 B2
(45) **Date of Patent: *Aug. 23, 2016**

(54) FLUID STABBING DOG

(71) Applicant: Cameron International Corporation, Houston, TX (US)

(72) Inventors: Jerod C. Bushman, Tomball, TX (US); John B. Hankins, Cleveland, TX (US); John A. Hoefler, Cypress, TX (US); Harold A. Tenorio, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/752,866

(22) Filed: Jun. 27, 2015

(65) Prior Publication Data

US 2016/0024879 A1 Jan. 28, 2016

Related U.S. Application Data

(63) Continuation of application No. 13/840,626, filed on Mar. 15, 2013, now Pat. No. 9,068,433.

(51) Int. Cl.

| | |
|---|---|
| ***E21B 7/12*** | (2006.01) |
| ***E21B 34/04*** | (2006.01) |
| ***E21B 41/00*** | (2006.01) |
| ***E21B 21/00*** | (2006.01) |
| ***E21B 17/01*** | (2006.01) |

(52) U.S. Cl.
CPC ..... *E21B 34/04* (2013.01); *E21B 17/01* (2013.01); *E21B 21/001* (2013.01); *E21B 41/0007* (2013.01)

(58) Field of Classification Search
CPC ..... E21B 41/0007
USPC ..... 166/338, 344, 360
See application file for complete search history.

(56) References Cited

U.S. PATENT DOCUMENTS

| | | | |
|---|---|---|---|
| 4,456,062 | A | 6/1984 | Roche et al. |
| 5,727,630 | A | 3/1998 | Brammer |
| 6,394,194 | B1 | 5/2002 | Queen et al. |
| 9,068,433 | B2 | 6/2015 | Bushman et al. |
| 2011/0008099 | A1 | 1/2011 | Larson et al. |
| 2012/0000664 | A1 | 1/2012 | Nas et al. |

*Primary Examiner* — Matthew R Buck
*Assistant Examiner* — Aaron Lembo
(74) *Attorney, Agent, or Firm* — Eubanks PLLC

(57) ABSTRACT

A diverter system having stabbing dogs is provided. In one embodiment, such a system includes a diverter, a housing, and a plurality of stabbing dogs coupled to the housing. The stabbing dogs are positioned to enable locking elements of the stabbing dogs to be extended into recesses in the diverter to secure the diverter within the housing. At least one of the recesses in the diverter is connected to a fluid conduit within the diverter, and at least one stabbing dog includes a fluid passage that enables fluid to be routed into the fluid conduit within the diverter through the at least one stabbing dog. Additional systems, devices, and methods are also disclosed.

19 Claims, 13 Drawing Sheets

FLUID STABBING DOG

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource.

By way of example, an offshore drilling system typically includes a marine riser that connects a drilling rig to subsea wellhead equipment, such as a blowout preventer stack connected to a wellhead. A drill string can be run from the drilling rig through the marine riser into the well. Drilling mud can be routed into the well through the drill string and back up to the surface in the annulus between the drill string and the marine riser. Unexpected pressure spikes can sometimes occur in the annulus, such as from pressurized formation fluid entering the well (also referred to as a "kick"). For this reason, the marine riser can include a diverter for sealing the return path through the riser and redirecting flow away from the drill floor of the drilling rig.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Some embodiments of the present disclosure generally relate to locking dogs having extendable locking elements and stabs with passages for conveying fluid through the locking dogs to another device (e.g., a diverter). Such locking dogs are also referred to herein as stabbing dogs. In one embodiment, stabbing dogs are mounted on a housing for receiving a diverter. The stabbing dogs of this embodiment include locking elements with integral stabs disposed therein. The locking elements can be extended to engage a diverter and secure it within the housing. Extension of the locking elements also causes the stabs to engage the diverter and complete one or more fluid connections between the stabs and the diverter. Control fluid can then be routed into the diverter through the stabs of the stabbing dogs to control operation of the diverter. For instance, in one embodiment, control fluid may be provided through the stabbing dogs to control opening of an annular preventer in the diverter, closing of the annular preventer, and energizing of seals between the diverter and the housing.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
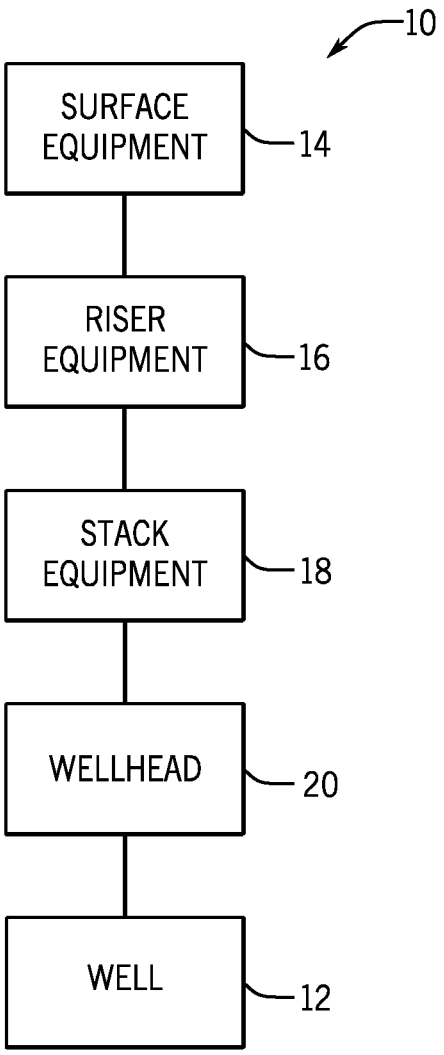
FIG. 1 generally depicts a subsea system for accessing or extracting a resource, such as oil or natural gas, via a well in accordance with an embodiment of the present disclosure.

Turning now to the present figures, a system 10 is illustrated in FIG. 1 in accordance with one embodiment. Notably, the system 10 (e.g., a drilling system or a production system) facilitates accessing or extraction of a resource, such as oil or natural gas, from a well 12. Although the system 10 may take the form of an onshore system in other embodiments, the system 10 is depicted in FIG. 1 as an offshore system that includes surface equipment 14, riser equipment 16, and stack equipment 18, for accessing or extracting the resource from the well 12 via a wellhead 20. In one subsea drilling application, the surface equipment 14 includes a drilling rig above the surface of the water, the stack equipment 18 (i.e., a wellhead assembly) is coupled to the wellhead 20 near the sea floor, and the riser equipment 16 connects the stack equipment 18 to the drilling rig and other surface equipment 14.

As will be appreciated, the surface equipment 14 can include a variety of devices and systems, such as pumps, power supplies, cable and hose reels, a rotary table, a top drive, control units, a gimbal, a spider, and the like, in addition to the drilling rig. The stack equipment 18, in turn, can include a number of components, such as blowout preventers, that enable control of fluid from the well 12. Similarly, the riser equipment 16 can also include a variety of components, such as riser joints, flex joints, a telescoping joint, fill valves, a diverter, and control units, some of which are depicted in FIG. 2 in accordance with one embodiment.

Figure 2:
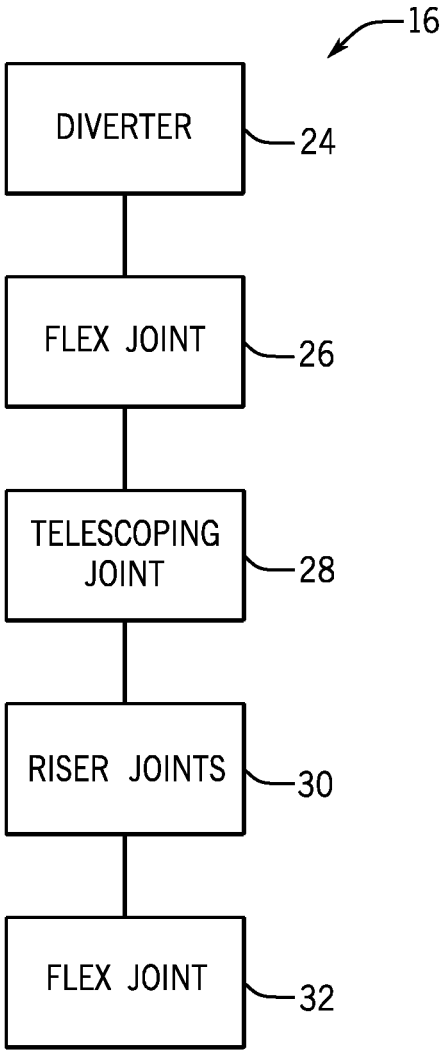
FIG. 2 is a block diagram of a diverter and other various components of riser equipment of FIG. 1 in accordance with one embodiment.

Particularly, in the embodiment of FIG. 2, the riser equipment 16 is provided in the form of a marine riser that includes a diverter 24, an upper flex joint 26, a telescoping joint 28, riser joints 30, and a lower flex joint 32. A marine riser is generally a tube (typically including a series of riser joints 30) that connects an offshore drilling rig to wellhead equipment installed on the seabed. In some instances, a floating drilling rig (e.g., a semisubmersible or drilling ship) is used to drill the well 12. Waves or other forces on the floating rig can cause the rig and other surface equipment 14 to move with respect to the stack equipment 18 at the well 12. To accommodate such motion, the upper flex joint 26 can be connected to or near the surface equipment 14 and the lower flex joint 32 can be coupled to or near the stack equipment 18. These flex joints 26 and 32 allow angular displacement of the riser string between these flex joints (including the telescoping joint 28 and the riser joints 30) and accommodate lateral motion of the floating rig on the water's surface above the stack equipment 18. Complementing the flex joints 26 and 32, the telescoping joint 28 compensates for heave (i.e. up-down motion) of the drilling rig generally caused by waves at the surface.

At various operational stages of the system 10, fluid can be transmitted between the well 12 and the surface equipment 14 through the riser equipment 16. For example, during drilling, a drill string is run from the surface, through a riser string of the riser equipment 16 (e.g., through the diverter 24, the flex joints 26 and 32, the telescoping joint 28, and a series of connected riser joints 30), and into the well 12 to bore a hole in the seabed. Drilling fluid (also known as drilling mud) is circulated down into the well 12 through the drill string to remove well cuttings, and this fluid returns to the surface through the annulus between the drill string and the riser string.

The diverter 24 operates to protect the drilling rig and other surface equipment 14 from pressure kicks traveling up from the well 12 through the marine riser. Such pressure kicks can be caused by pressurized formation fluids entering the well 12. As discussed in greater detail below, the diverter 24 includes an annular preventer for sealing the fluid path from the well 12 when a pressure kick is detected. The pressurized fluid during a kick can be routed away from the drilling rig through one or more ports in the diverter. In some embodiments, the diverter 24 is installed on the underside of a drill floor of a drilling rig and is connected to the upper flex joint 26 as part of a marine riser.

Figure 3:
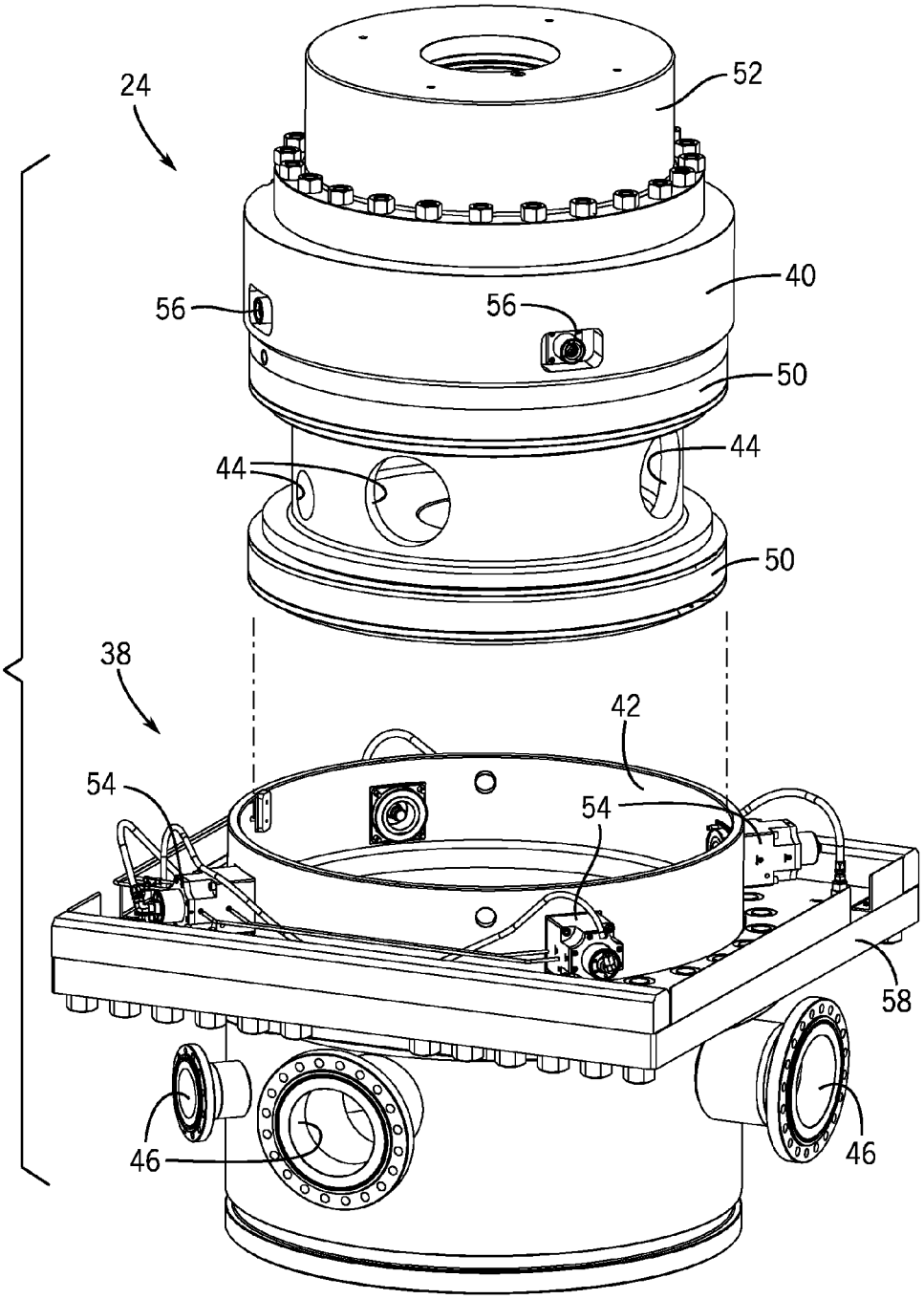
FIG. 3 is an exploded view generally depicting a diverter, its housing, and locking dogs for holding the diverter within the housing in accordance with one embodiment.
Figure 4:
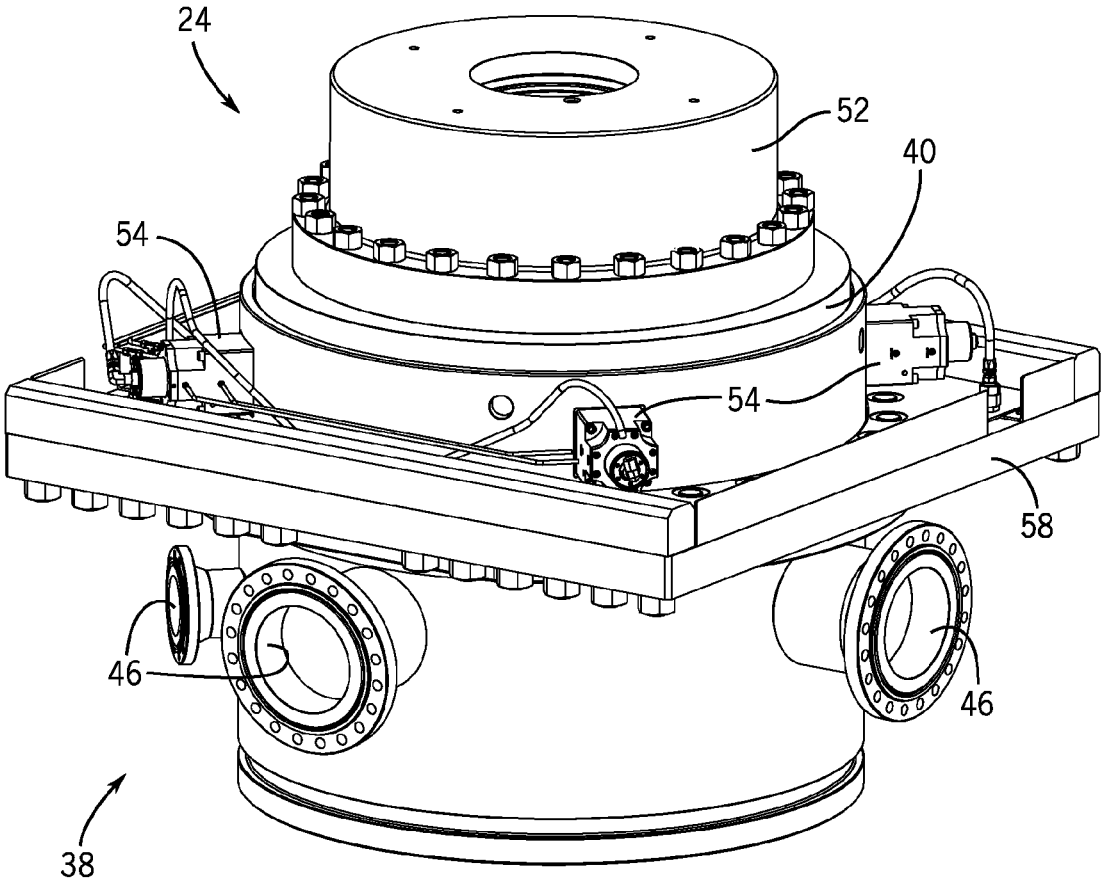
FIG. 4 is a perspective view showing the diverter of FIG. 3 received within its housing.

One example of a diverter 24 is illustrated in FIGS. 3 and 4. In this embodiment, the diverter 24 includes a body 40 sized to fit within a bore 42 of a diverter housing 38. The diverter housing 38 can be mounted to the underside of a drilling rig floor. The diverter 24 includes multiple fluid ports 44 that allow fluid to pass out of the diverter 24, through fluid ports 46 of the housing 38, and into pipes (e.g., flowlines and diverter lines) connected to the housing. These pipes can include valves to control flow from the diverter 24. Seals 50, which may also be referred to as flowline seals, are provided about the body 40 to seal against the bore 42 of the housing 38 to inhibit fluid passing between ports 44 and 46 from leaking out of the diverter 24. An end cap 52 houses components of the annular preventer (see FIG. 12) and includes an opening to allow items (e.g., a casing string or a drill string) to pass through the diverter 24.

Locking dogs 54 are mounted on the housing 38 and include locking elements (also referred to herein as "dogs") that can be extended into recesses of the diverter 24 to secure the diverter within the housing and to keep the diverter seated within the housing during a pressure kick. In at least some embodiments, including that depicted in FIGS. 3 and 4, the locking dogs 54 include not only locking elements, but also stabs with fluid conduits that engage receptacles 56 within recesses of the diverter 24 to provide control fluid (e.g., hydraulic control fluid) that enables control of certain functions (e.g., hydraulic functions) of the diverter 24. Such functions could include closing the annular preventer of the diverter 24, opening the annular preventer, and energizing the flowline seals 50 to name several examples, although the diverter 24 could have other or additional functions implemented with control fluid provided through the locking dogs 54 in other embodiments. The term "stabbing dog" is used herein to mean a locking dog having both a locking element and a stab for conveying control fluid to the diverter 24. Thus, the locking dogs 54 in FIGS. 3 and 4 may also be referred to herein as stabbing dogs 54.

The inclusion of the fluid stabs within the locking dogs 54 allows the fluid connections to be made with the diverter in a "hands-free" manner, in contrast to some previous systems in which a user manually connects separate, hard-to-access fluid connections to the diverter (e.g., while suspended below the drill floor over a moon pool). The integration of the fluid stabs in the locking dogs 54 also reduces the number of separate connections, which may simplify installation of a diverter and reduce alignment issues between the diverter and the housing. And while the presently disclosed stabbing dogs 54 are described herein as being used for retaining and making fluid connections with a diverter, the stabbing dogs 54 could also be used in other applications. That is, the stabbing dogs 54 could also or instead be used to engage and make fluid connections with other components (besides a diverter) in full accordance with the present techniques.

The receptacles 56 may be radially aligned with the stabbing dogs 54 with a keyed arrangement (such as the key on the left side of bore 42 in FIG. 3) and vertically aligned by the engagement of mating shoulders of the body 40 (above the fluid ports 44 in FIG. 3) and the bore 42 (below the stabbing dogs 54). The housing 38 may also include a connection plate 58 with various fittings for routing control fluid through hoses or pipes into the stabbing dogs 54 and the diverter 24.

Figure 5:
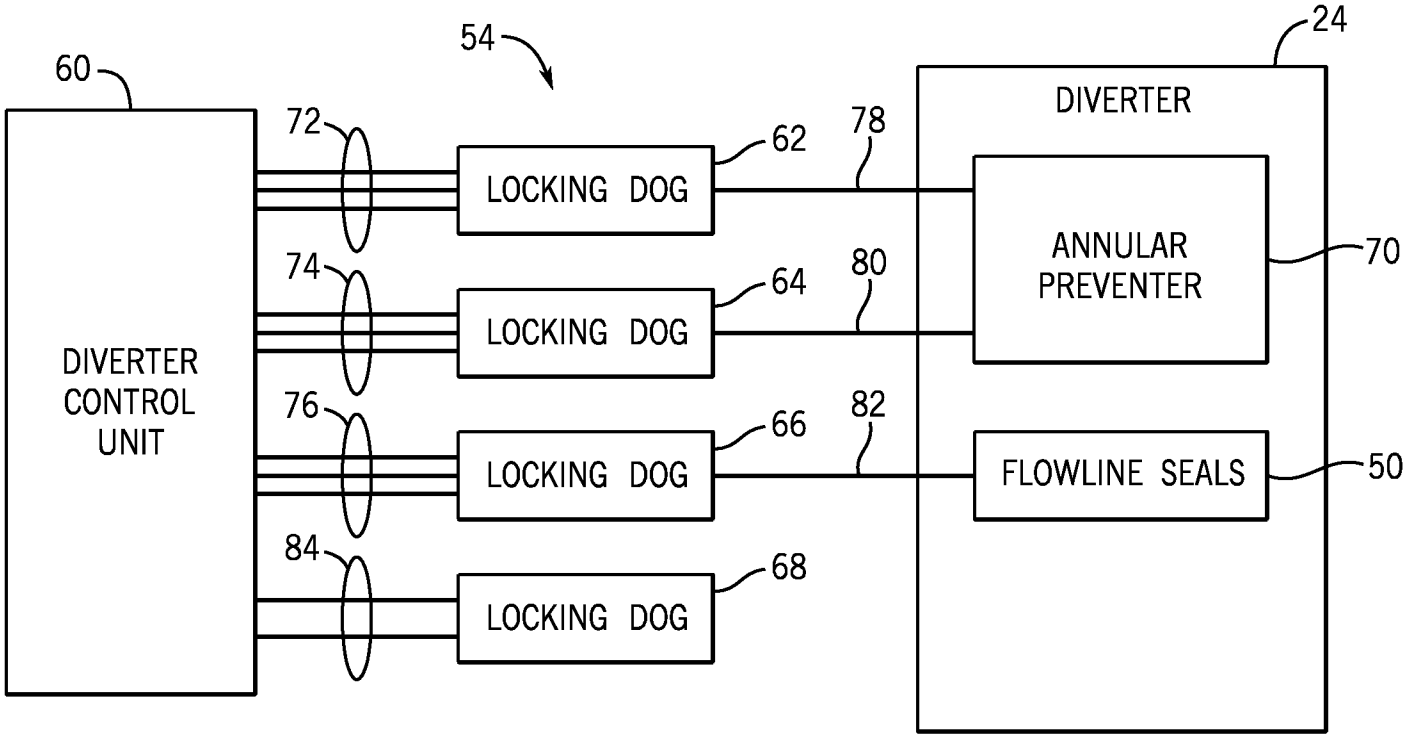
FIG. 5 is a block diagram generally representing fluid connections between a diverter, locking dogs, and a diverter control unit in accordance with one embodiment.

A block diagram generally illustrating fluid connections among the locking dogs 54, the diverter 24, and a diverter control unit 60 is depicted in FIG. 5 in accordance with one embodiment. In this example, the diverter control unit 60 provides control fluid to the locking dogs 54. The diverter control unit 60 can include any suitable components, such as a computer system (e.g., with a processor and memory having stored instructions for carrying out the control functions described herein) and a pump for outputting control fluid to the locking dogs 54. Individual locking dogs 54 are here denoted by reference numerals 62, 64, 66, and 68, and the locking dogs 54 are connected to provide control fluid to the flowline seals 50 and an annular preventer 70 of the diverter 24.

More specifically, as presently depicted, the locking dogs 62, 64, and 66 are connected to the diverter control unit 60 by fluid lines 72, 74, and 76. In at least some embodiments, the locking dogs 54 are hydraulically actuated. That is, hydraulic control fluid is pumped into the locking dogs 54 to extend and retract their locking elements. Accordingly, each set of fluid lines 72, 74, and 76 in FIG. 5 includes two lines for that purpose. The third line of each set represents a fluid line for routing control fluid through the locking dogs and into the diverter 24 (via fluid connections 78, 80, and 82) to control operating functions of the diverter. For instance, fluid may be pumped through the locking dog 62 and the fluid connection 78 to open the annular preventer 70, through the locking dog 64 and the fluid connection 80 to close the annular preventer 70, and through the locking dog 66 and the fluid connection 82 to energize the flowline seals 50. Fluid lines 84 connect the diverter control unit 60 to the locking dog 68 and include two lines to hydraulically control the extension and retraction of its locking element, as described above for the other locking dogs. In the embodiment of FIG. 5, the locking dog 68 does not provide control fluid to the diverter 24. But in other embodiments, the locking dog 68 could enable control of a diverter function by providing such control fluid through an integrated stab.

Figure 6:
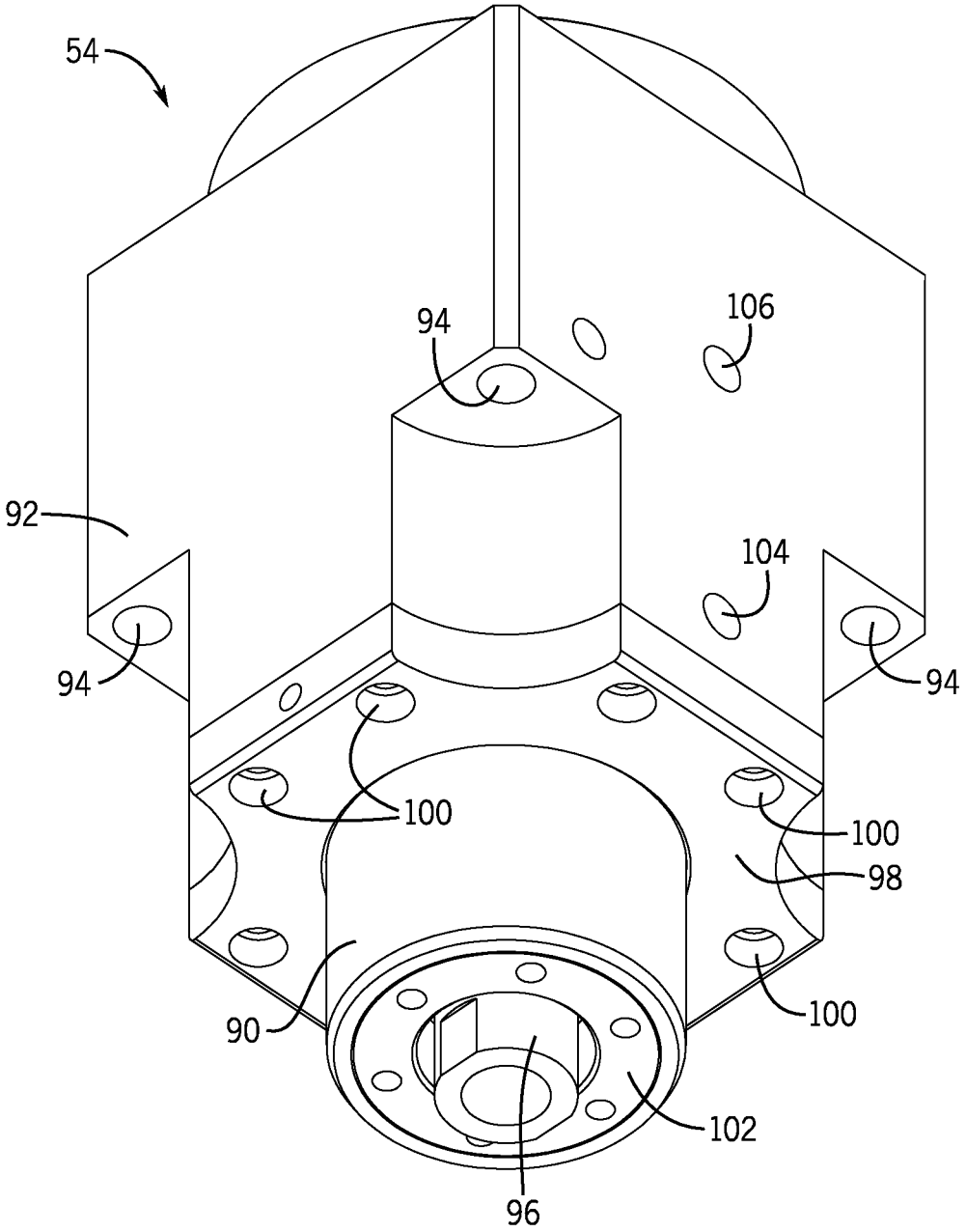
FIGS. 6 and 7 are perspective views of a locking dog having an extendable locking element and an integrated male fluid stab in accordance with one embodiment.
Figure 7:
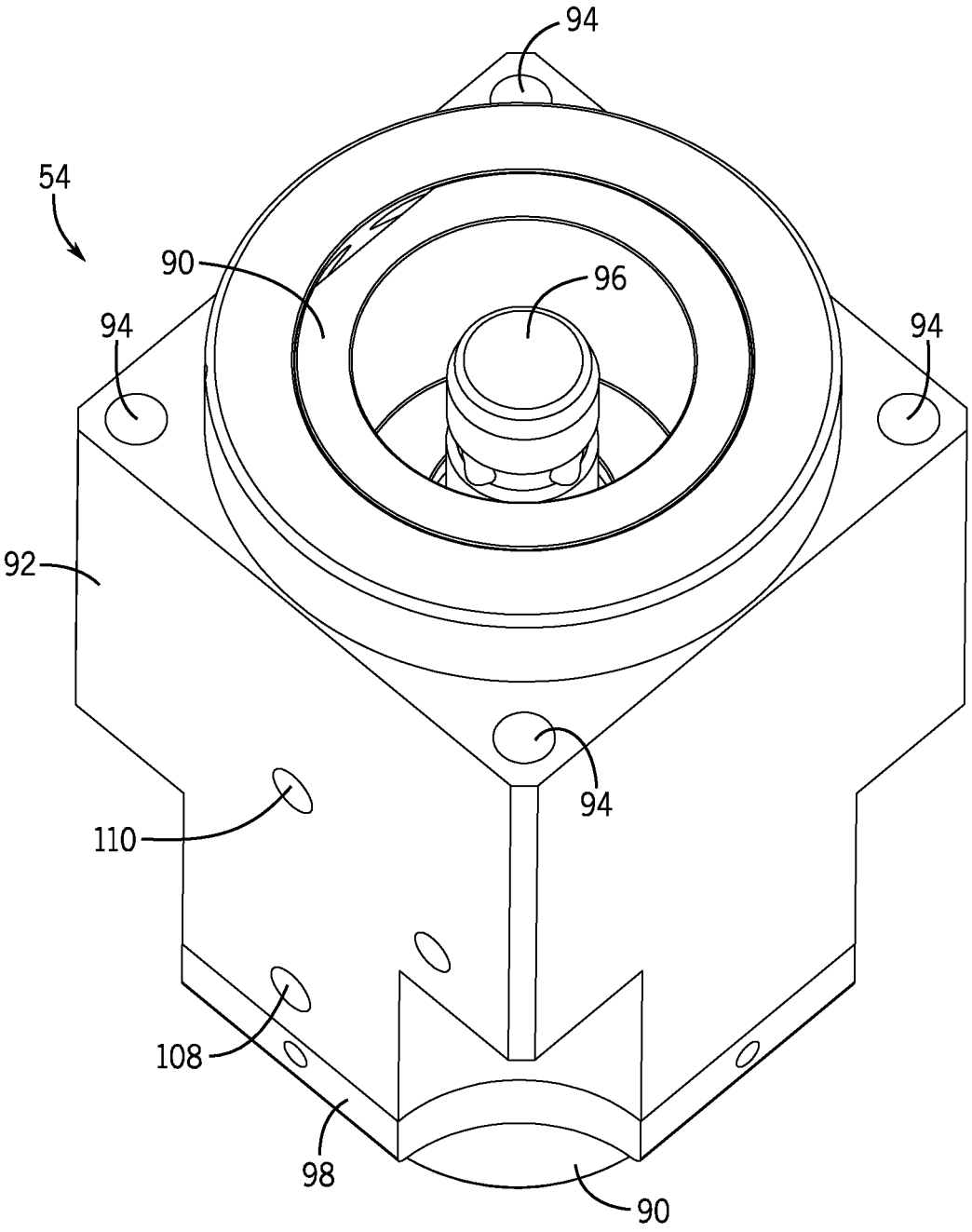

A locking dog 54 is depicted in FIGS. 6 and 7 in accordance with one embodiment. The locking dog 54 in this example includes a locking element or dog 90 installed in a housing 92. The dog 90 can be extended from the housing 92 to engage a recess in the diverter 24 to retain the diverter 24 within the diverter housing 38 (e.g., during a pressure kick). The locking dog housing 92 includes mounting holes 94 to allow the locking dog 54 to be fastened to the diverter housing 38. The locking dog 54 of this example also includes a male fluid stab 96 provided within the dog 90 for conveying fluid to the diverter 24; accordingly, this locking dog 54 may also be considered to be a stabbing dog 54. A back plate 98 is provided to retain the dog 90 in the housing 92 and can be fastened to the housing 92 via mounting holes 100. A cylinder cap 102 is similarly provided to retain the stab 96 (as well as other components described below) within the dog 90. The cylinder cap 102 can be threaded into the end of the dog 90 or attached in any other suitable manner. In the present embodiment, the dog 90 is a linear actuator (e.g., a hydraulic cylinder) that extends and retracts in response to pressure applied via fluid port 104 (to extend) and fluid port 106 (to retract). The housing also includes ports 108 and 110 to enable fluid for controlling the extension and retraction of the dog 90 to be routed through the locking dog 54 to another locking dog 54 (e.g., to facilitate synchronous operation of multiple locking dogs 54).

Figure 8:
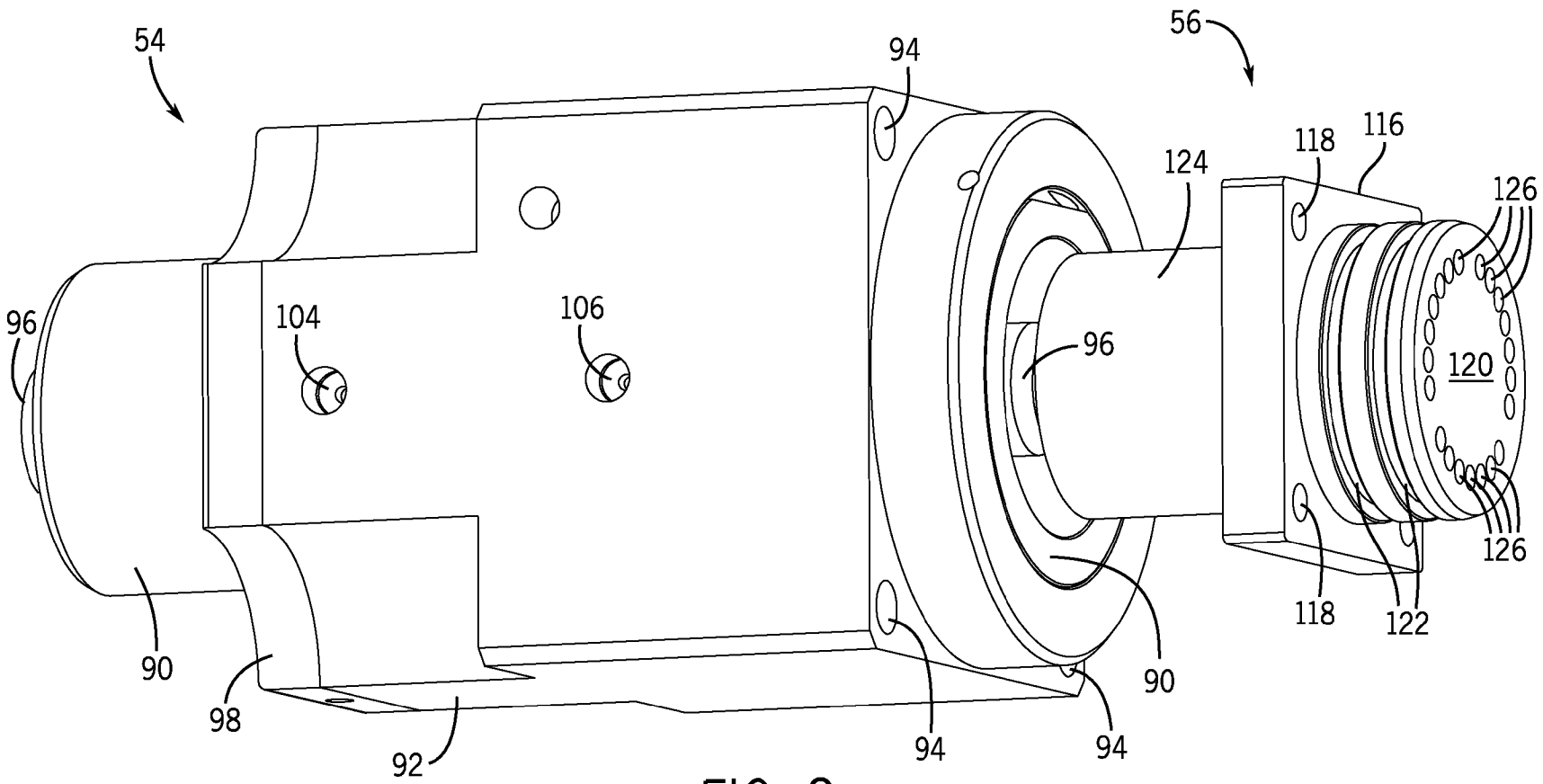
FIG. 8 is generally depicts alignment of the locking dog of FIGS. 6 and 7 with a receptacle of a diverter for conveying fluid from the stab of the locking dog into the diverter in accordance with one embodiment.

An example of a female receptacle 56 for engaging the locking dog 54 is depicted in FIG. 8 as being removed from the diverter 24 for the sake of explanation. The receptacle 56 includes a mounting plate 116 with holes 118 to allow the receptacle to be fastened into a recess of the diverter, as generally depicted in FIGS. 3 and 4. The receptacle 56 includes a plug portion 120 with seal grooves 122 for holding seals (not shown in this figure) to engage the recess into which the receptacle 56 is installed. The receptacle 56 is also depicted as including a cylindrical receiving portion 124. When the dog 90 is extended from the housing 92 toward the receptacle 56, the dog 90 is received about the outside of the cylindrical receiving portion 124 while the stab 96 is received within the portion 124. Fluid from the stab 96 may then be routed the receptacle 56 via ports 126 and then directed elsewhere within the diverter 24.

Figure 9:
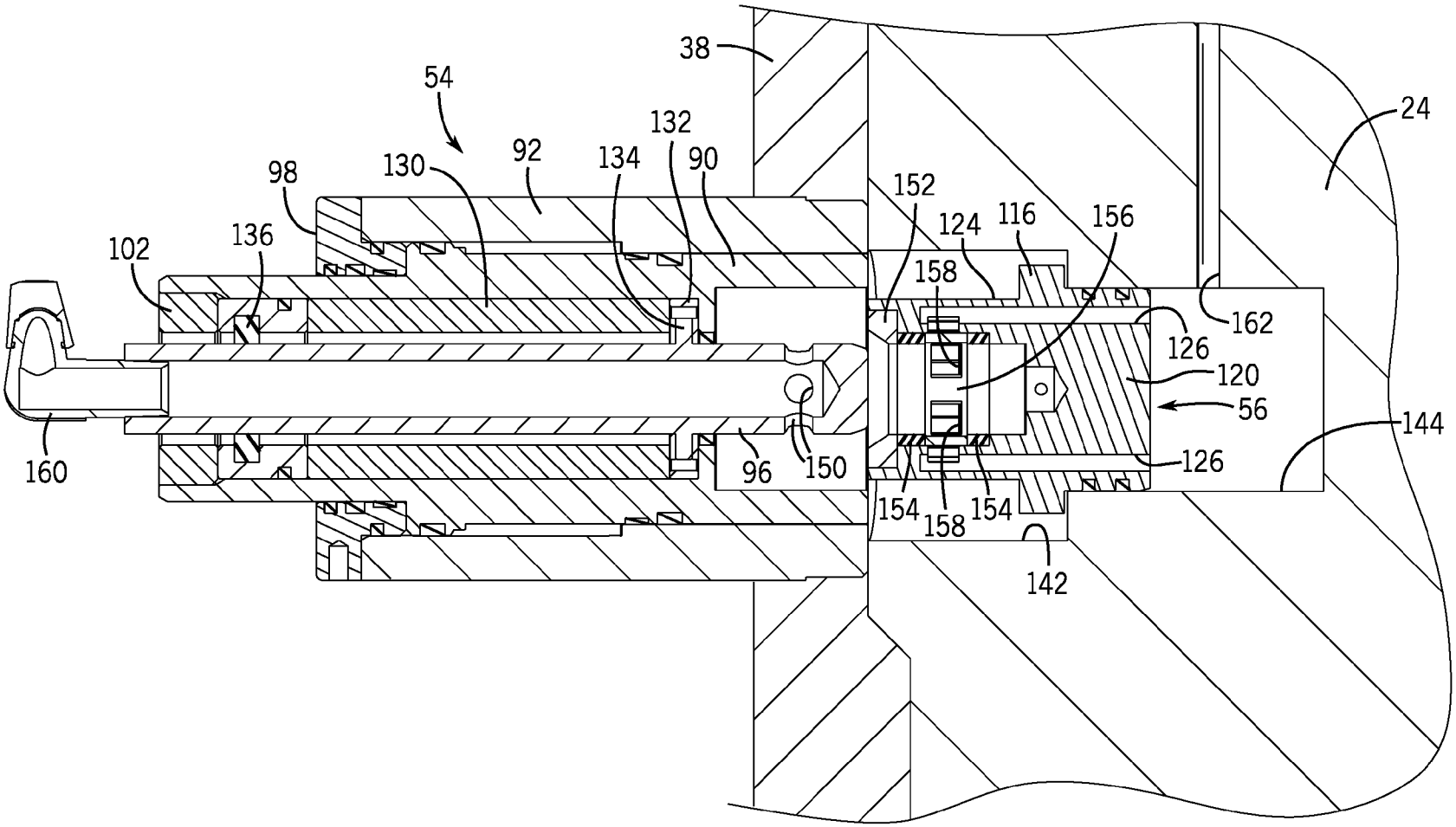
FIGS. 9 and 10 are cross-sections of the locking dog and the receptacle of FIG. 8 installed in the diverter and its housing, with the locking element and stab of the locking dog retracted in FIG. 9 and extended into engagement with the receptacle in FIG. 10, in accordance with one embodiment.
Figure 10:
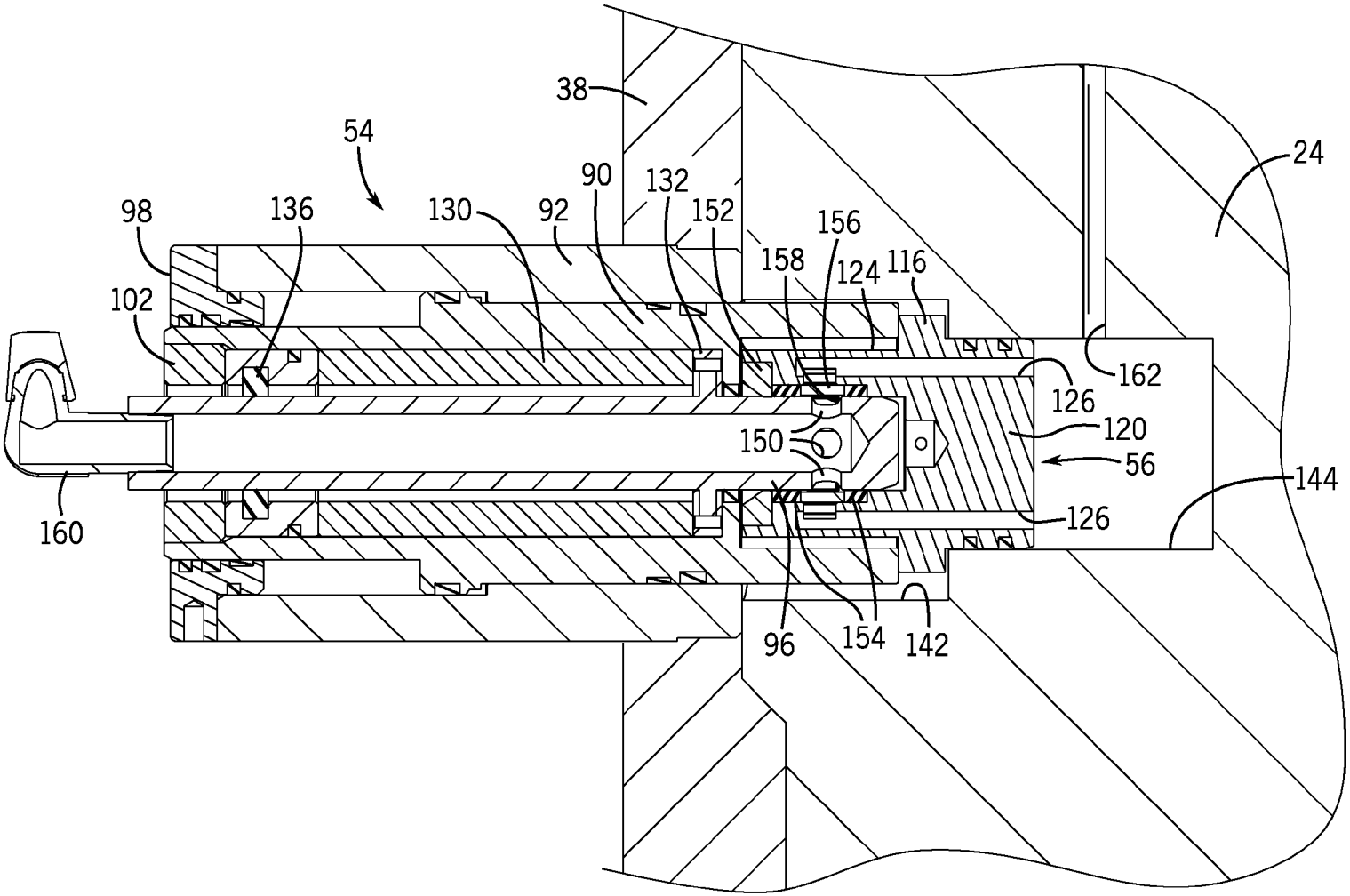

Operation of the locking dog 54 to hold the diverter 24 within the housing 38 and to complete a fluid connection between the stab 96 and the diverter 24 may be better understood with reference to FIGS. 9 and 10. Particularly, FIG. 9 depicts the receptacle 56 aligned with the locking dog 54 (having a retracted dog 90) when the diverter 24 is installed in the housing 38, while FIG. 10 depicts extension of the dog 90 and the stab 96 to engage the receptacle 56. In the illustrated embodiment, the locking dog 54 includes a spacer 130 disposed between the dog 90 and the stab 96, as well as a spacer sleeve 132 disposed about a shoulder 134 of the stab 96. The spacer 130 has an inner diameter that is larger than the outer diameter of the stab 96 such that the spacer 130 is spaced apart from the stab 96. This gives the stab 96 radial freedom of movement within the spacer 130. And in conjunction with the spacer sleeve 132, this also allows the stab 96 enough space to "float" within the dog 90 to self-align with the receptacle 56 during extension of the dog 90. Such floating of the stab 96 may also account for tolerance stack-ups while keeping a sealed connection. A rear wiper ring 136 is provided inside the cylinder cap 102 to provide a wiper function for the stab 96 and the spacer 130. It is also noted that the back plate 98 can provide bearing support, sealing, and wiper functions for the extendable dog 90.

Fluid may be pumped into the locking dog 54 (e.g., via port 104) to extend the dog 90 into a recess 142 in which the receptacle 56 is installed. As generally noted above, the plug portion 120 of the receptacle can include seals that seal against a surface 144 of the recess 142 to inhibit fluid passing through the stab 96 (via ports 150) and the fluid ports 126 from leaking out of the recess. As the dog 90 is extended from the position shown in FIG. 9 to that shown in FIG. 10, an angled lead-in ring 152 facilitates alignment of the stab 96 with the receptacle 56. Seals 154 and a spacer cage 156 are provided within the receptacle 56 and are retained by the lead-in ring 152. The seals 154 (e.g., elastomeric seals) receive and seal against the stab 96, and the ports 150 of the stab 96 are positioned between the seals 154 opposite the spacer cage 156. This allows control fluid to be routed through the stab 96 (e.g., from a hose connected to fitting 160 on one end of the stab), out the ports 150, through openings 158 in the spacer cage 156 to fluid conduits 126, and from these fluid conduits 126 to a fluid conduit (e.g., fluid conduit 162) leading from the recess 142 to another portion of the diverter 24.

Figure 11:
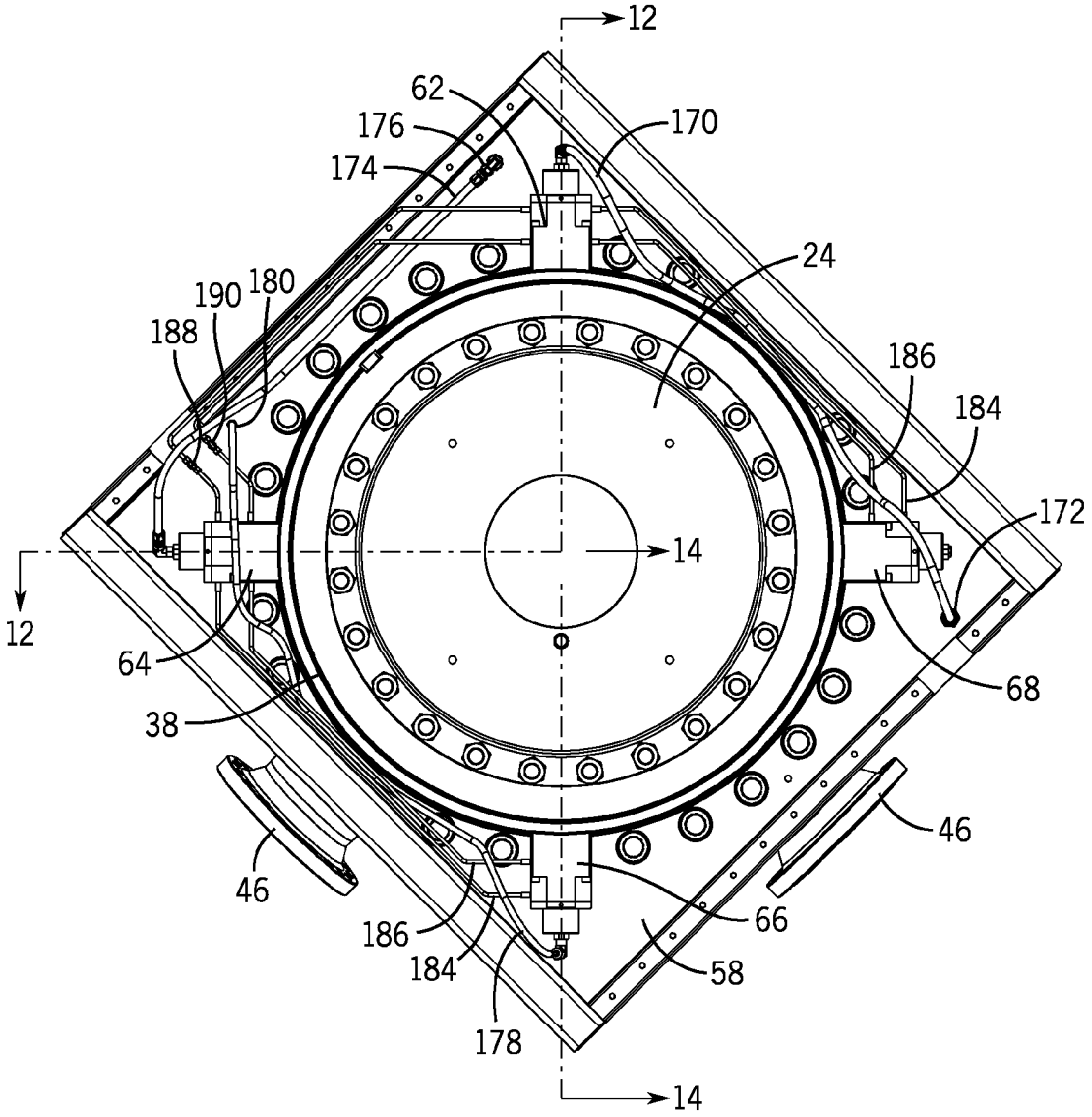
FIG. 11 is a top plan view of the diverter and housing of FIGS. 3 and 4, and shows fluid connections from a connection plate to the locking dogs in accordance with one embodiment.

Although fluid connections to the locking dogs 54 could be made in any suitable way, in some embodiments fluid lines to the locking dogs 54 are generally provided on the connection plate 58. One example of such an arrangement is shown in FIG. 11. In this embodiment, and as previously depicted in FIG. 5, the locking dogs 54 include individual locking dogs 62, 64, 66, and 68. A hose 170 connects the stab 96 of the locking dog 62 to a fitting 172 on the connection plate 58 to allow control fluid to be routed from the fitting 172, through the hose 170 and the stab 96 of the locking dog 62, and into the diverter 24 to control an operational aspect of the diverter (e.g., opening the annular preventer 70). Hoses 174 and 178 are similarly connected (that is, between respective stabs 96 of the locking dogs 64 and 66 and fittings 176 and 180 of the connection plate 58) to provide control fluid into the diverter 24 to control operational aspects (e.g., closing the annular preventer 70 and energizing flowline seals 50).

The locking elements of the locking dogs 62, 64, 66, and 68 may be extended and retracted in the manner generally described above, and piping 184 and 186 is connected to various ports (e.g., via fittings on ports 104, 106, 108, and 110 of FIGS. 6 and 7) of the locking dogs to enable actuation of their locking elements. Particularly, in the present embodiment, hydraulic control fluid can be routed from a fitting 188 on the connection plate 58 to the locking dogs through piping 184 to extend the locking elements and engage the diverter 24. Conversely, hydraulic control fluid can be routed from a fitting 190 on the connection plate 58 to retract the locking elements and release the diverter 24. In at least one embodiment, the diverter control unit 60 (FIG. 5) is connected in fluid communication with the various fittings on the connection plate 58 to enable the diverter control unit 60 to pump control fluid through the hoses and piping discussed above via the fittings. For example, the fittings 172, 176, 180, 188, and 190 can be connected to ports through the connection plate 58 and hoses or pipes from the diverter control unit 60 can be connected to the ports on the underside of the connection plate 58 to enable fluid from the diverter control unit to be pumped into the diverter 24 via the stabbing dogs 54.

Figure 12:
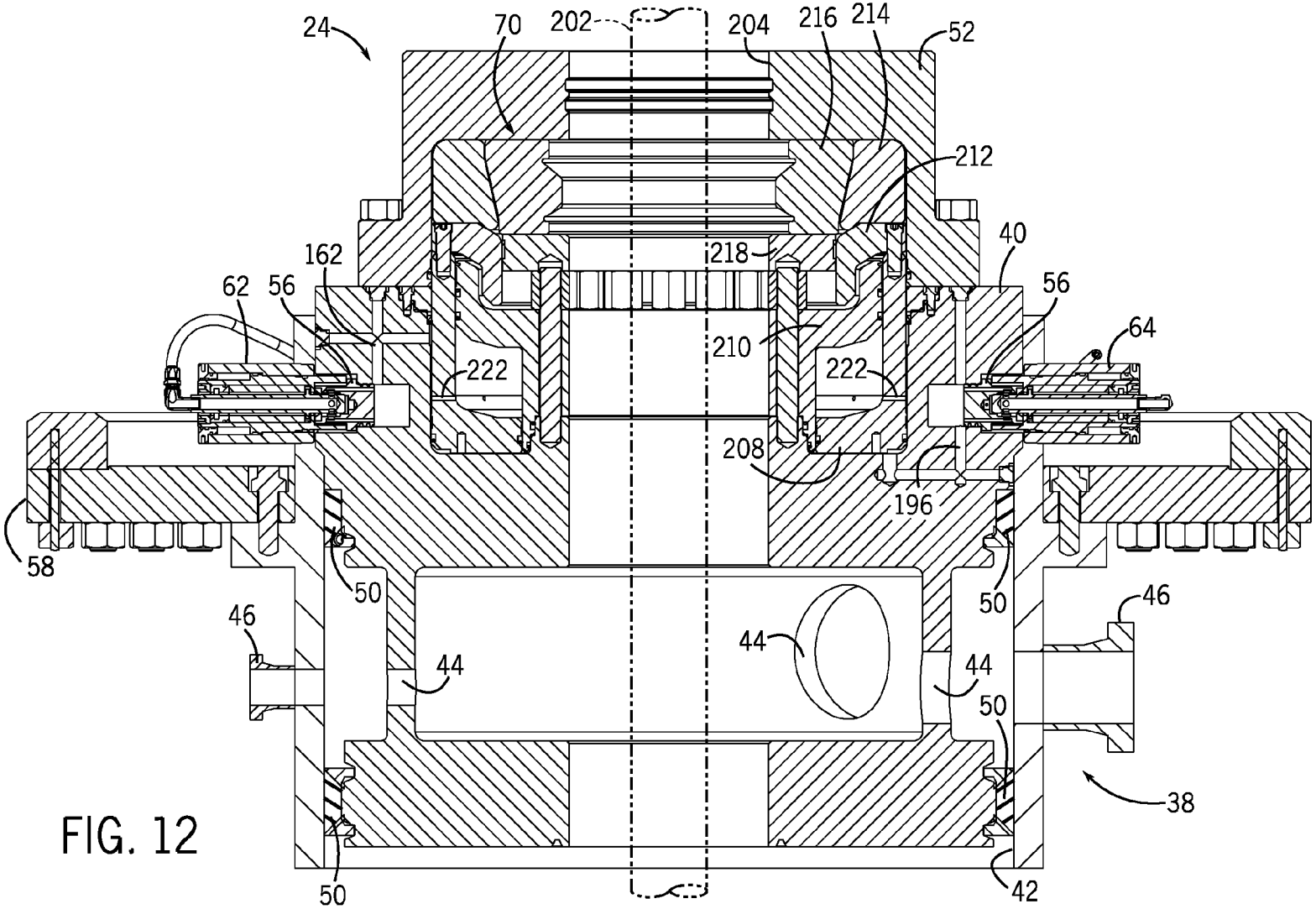
FIGS. 12 and 13 are section views generally depicting operation of an annular preventer of the diverter by way of control fluid routed into the diverter from locking dogs in accordance with one embodiment.
Figure 13:
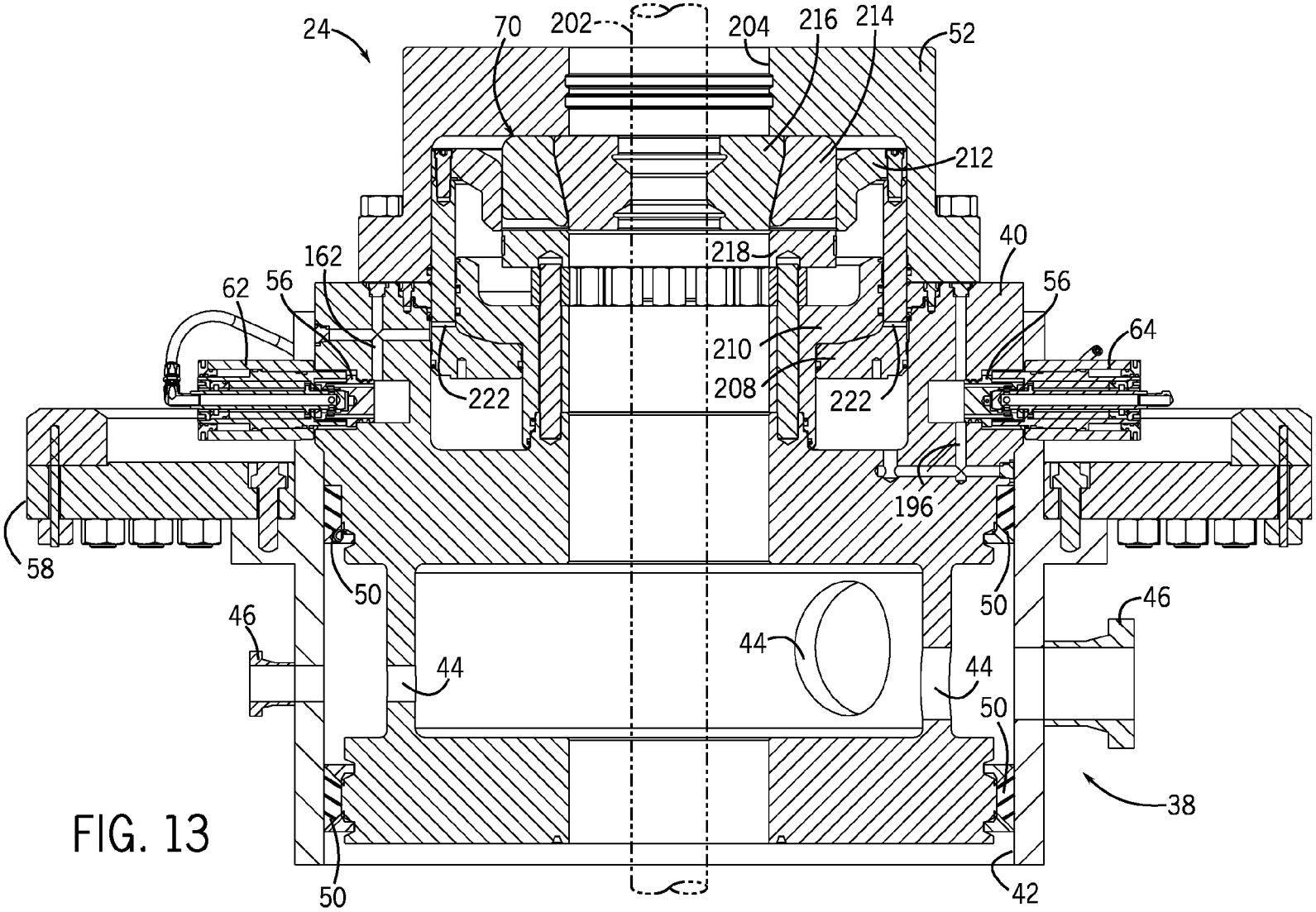
Figure 14:
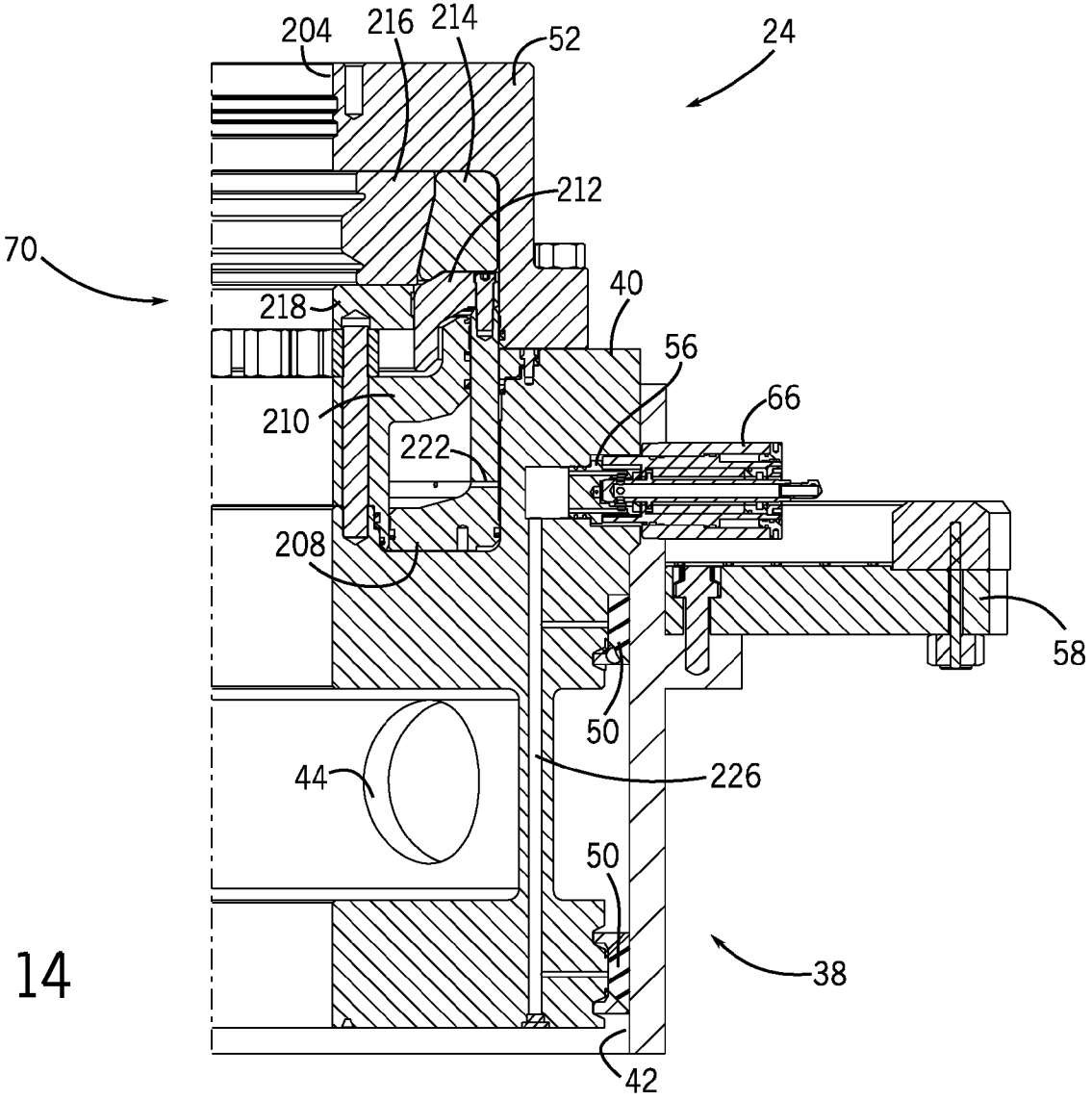
FIG. 14 is a section view of a locking dog in fluid communication with a conduit of the diverter to enable control fluid pumped through the locking dog to energize flowline seals of the diverter in accordance with one embodiment.

Certain examples showing the locking dogs 54 as placed in fluid communication with conduits in the diverter 24 to control operational aspects of the diverter are provided in FIGS. 12-14. More specifically, the example depicted in FIGS. 12 and 13 generally shows that the annular preventer 70 of the diverter 24 can be closed and opened with fluid from the locking dogs 62 and 64, and the example depicted in FIG. 14 shows that the flowline seals 50 can be energized with fluid from the locking dog 66, as generally described above with respect to FIG. 5. But while these specific examples are provided for explanatory purposes, it will be appreciated that other operational aspects could also or instead be controlled via fluid routed through one or more locking dogs 54.

In FIGS. 12 and 13, the locking dog 62 (through extension of its locking element 90) engages a mating receptacle 56 to place the stab 96 of the locking dog 62 in fluid communication with the conduit 162 in the diverter 24. In a similar manner, the locking dog 64 engages a mating receptacle 56 to place its stab 96 in fluid communication with a conduit 196 in the diverter 24. As here depicted, the conduits 162 and 196 generally lead to the annular preventer 70, allowing control fluid (e.g., hydraulic fluid) to be routed to the annular preventer 70 to control opening and closing of the annular preventer 70 to selectively inhibit fluid from passing to the drilling rig through the diverter 24. The annular preventer 70 can seal about a member 202 (e.g., a drill string) extending through a bore 204 of the diverter 24. Or, in some instances, the annular preventer 70 could also or instead be adapted to seal an open bore 204 without such a member 202.

The annular preventer 70 includes a piston 208 configured to move along a spacer 210. To close the annular preventer 70, control fluid is pumped into the stab 96 of the locking dog 64 (e.g., from hose 174 of FIG. 11) and this control fluid is routed through the receptacle 56 and the fluid conduit 196 to drive the piston 208 upward from the position depicted in FIG. 12 to that depicted in FIG. 13. As the piston 208 is driven upward, a plunger 212 connected to the piston 208 is driven into and compresses an element 214. This, in turn, causes the compressed element 214 to move radially inward, which also pushes a packer 216 (or other sealing element) into sealing engagement within the diverter 24 (e.g., about the drill string or other member 202) to inhibit fluid flow through the diverter 24 to the drilling rig. The annular preventer 70 also includes a retaining ring 218 to retain the packer 216 within the end cap 52. The annular preventer 70 can be opened by pumping control fluid into the stab 96 of the locking dog 62 (e.g., from hose 170 of FIG. 11). The fluid pumped into the locking dog 62 can be routed through conduit 162 and through fluid ports 222 in the piston 208 to drive the piston 208 downward (i.e., from the position in FIG. 13 to that in FIG. 12). This allows the element 214 and the packer 216 to retract outward into the space vacated by the piston 208 and the plunger 212, thereby opening the bore 204.

Turning finally to FIG. 14, the locking dog 66 is shown as having engaged a receptacle 56. That is, the dog 90 of the locking dog 66 has been extended toward the receptacle 56 to hold the diverter 24 within the housing 38 and to place the stab 96 within the dog 90 in fluid communication with a conduit 226 in the diverter 24. In operation, control fluid can be pumped into the stab 96 of the locking dog 66 (e.g., from hose 178 of FIG. 11). This fluid may be conveyed through the stab 96 and the receptacle 56 to the conduit 226, and the increased pressure within the conduit 226 applies a radially outward force against the flowline seals 50, causing these flowline seals 50 to energize and seal against the bore 42 of the diverter housing 38. Fluid in the conduit 226 may be pumped out through the receptacle 56 and the stab 96 to release the seals (e.g., to facilitate removal of the diverter 24 from the housing 38).

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a first component;

a second component; and a plurality of stabbing dogs coupled to the second component and positioned to enable locking elements of the plurality of stabbing dogs to be extended into recesses in the first component to secure the first component to the second component, wherein at least one of the recesses in the first component is connected to a fluid conduit within the first component and at least one stabbing dog of the plurality of stabbing dogs includes a fluid passage that enables fluid to be routed into the fluid conduit within the first component through the at least one stabbing dog.

2. The system of claim 1, wherein the at least one stabbing dog includes a stabbing dog housing, an extendable locking element within the stabbing dog housing, and a male stab having the fluid passage disposed within the extendable locking element.

3. The system of claim 2, comprising a spacer disposed between the male stab and the extendable locking element.

4. The system of claim 3, wherein the spacer is spaced apart from the male stab to allow the male stab to float within the spacer.

5. The system of claim 2, comprising a female receptacle mounted within the at least one recess and configured to receive the male stab, the female receptacle including a cage disposed between two seals configured to seal against the male stab, the cage having openings to allow fluid to pass from the male stab, through the openings in the cage, out of fluid ports in the female receptacle, and into the fluid conduit.

6. The system of claim 2, wherein the stabbing dog housing includes fluid ports that enable the extendable locking element to be hydraulically driven within the stabbing dog housing.

7. The system of claim 1, wherein the first component includes an annular preventer having a piston and the fluid conduit enables fluid to be routed through the at least one stabbing dog to the piston to operate the annular preventer.

8. The system of claim 7, wherein the at least one stabbing dog includes:

a first stabbing dog in fluid communication with the annular preventer to enable the piston to be hydraulically driven to close a packer of the annular preventer; and a second stabbing dog in fluid communication with the annular preventer to enable the piston to be hydraulically driven to open the packer of the annular preventer.

9. The system of claim 1, comprising a seal between the first component and the second component.

10. The system of claim 9, wherein the at least one stabbing dog includes a stabbing dog in fluid communication with the seal in a manner that enables fluid from the stabbing dog to energize the seal between the first component and the second component.

11. The system of claim 1, comprising a marine riser including the first component.

12. A system comprising:

an oilfield component including hydraulic functions;

a support structure; and locking dogs for physically locking the oilfield component to the support structure, wherein the locking dogs include moveable hydraulic stabs configured to route hydraulic control fluid into the oilfield component to enable control of the hydraulic functions of the oilfield component, and wherein the moveable hydraulic stabs are extended into recesses to lock the oilfield component to the support structure.

13. The system of claim 12, wherein the oilfield component includes a diverter, the support structure includes a diverter housing, and the locking dogs are mounted on the diverter housing with the moveable hydraulic stabs extended into recesses in the diverter to lock the diverter to the diverter housing.

14. The system of claim 13, comprising a diverter control unit.

15. The system of claim 14, wherein the diverter housing includes a connection plate for making fluid connections between the diverter control unit and the locking dogs.

16. A method comprising:

positioning a first oilfield component within a second oilfield component;

extending a locking dog to retain the first oilfield component in the second oilfield component, wherein extending the locking dog also connects a fluid conduit within the locking dog to a fluid conduit within the first oilfield component; and routing hydraulic control fluid into the fluid conduit within the first oilfield component through the fluid conduit within the locking dog.

17. The method of claim 16, wherein the locking dog is mounted on the second oilfield component and extending the locking dog includes extending the locking dog into a recess in the first oilfield component.

18. The method of claim 16, wherein the first oilfield component includes a diverter and the second oilfield component includes a diverter housing, and extending the locking dog includes extending the locking dog into a recess in the diverter to retain the diverter within the diverter housing.

19. The method of claim 18, comprising extending multiple locking dogs to retain the diverter in the diverter housing such that stabs in the multiple locking dogs are placed in fluid communication with respective fluid conduits of the diverter.

* * * * *